US005769148A

United States Patent [19]

Kaiser et al.

[11] Patent Number: 5,769,148

[45] Date of Patent: Jun. 23, 1998

[54] OSCILLATING DEVICE FOR A CONTINUOUS CASTING MOLD

[75] Inventors: Hans-Peter Kaiser; Jürgen Hemmerle, both of Düsseldorf, Germany

[73] Assignee: SMS Schloemann-Siemag Aktiengesellschaft, Dusseldorf, Germany

[21] Appl. No.: 743,430

[22] Filed: Nov. 1, 1996

[30] Foreign Application Priority Data

Nov. 4, 1995 [DE] Germany ..... 195 41 164.1

[51] Int. Cl.[6] ..... B22D 11/04

[52] U.S. Cl. ..... 164/416; 164/478

[58] Field of Search ..... 164/416, 478

[56] References Cited

FOREIGN PATENT DOCUMENTS 4341719 4/1995 Germany .

WO95/03904 2/1995 WIPO ..... 164/416

*Primary Examiner*—Kuang Y. Lin

*Attorney, Agent, or Firm*—Friedrich Kueffner

[57] ABSTRACT

An oscillating device for a continuous casting mold, wherein the continuous casting mold is guided on a support frame and is moved in an oscillating manner by servo hydraulic cylinders arranged on the support frame. Each servo hydraulic cylinder is fastened at the bottom thereof through an elastic fastening element on the support frame and the piston rods of the servo hydraulic cylinders are connected with the mold. The fastening element is composed of an elastic bending web which on both sides thereof is provided with fastening flanges.

3 Claims, 1 Drawing Sheet

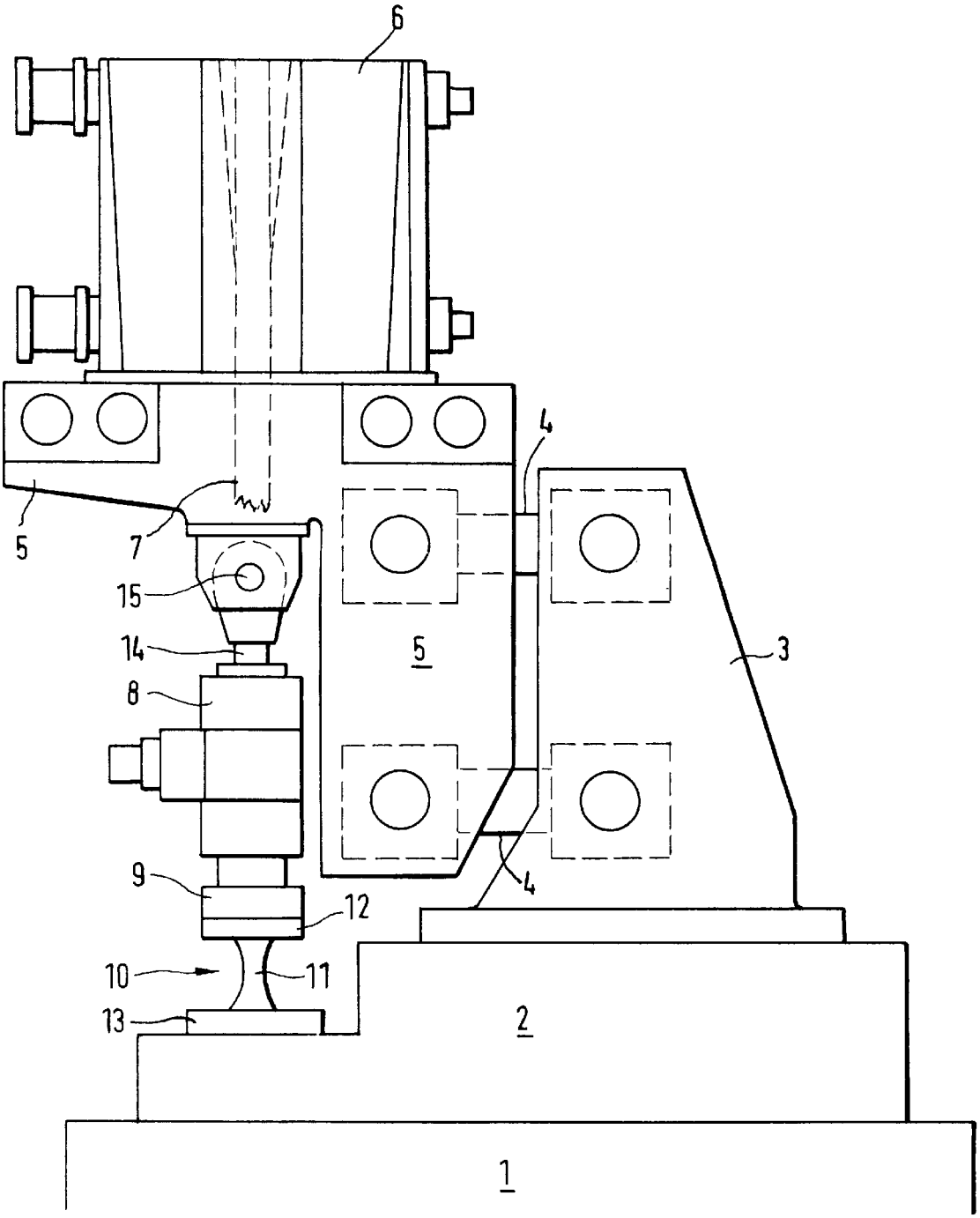
6
4
5
7
15
14
5
3
8
9
12
4
10
11
13
2
1

OSCILLATING DEVICE FOR A CONTINUOUS CASTING MOLD

BACKGROUND OF THE INVENTION

1. Field of the Invention

The present invention relates to an oscillating device for a continuous casting mold. The continuous casting mold is guided on a support frame and is moved in an oscillating manner by servo hydraulic cylinders arranged on the support frame.

2. Description of the Related Art

In a known oscillating device disclosed in DE-C1 43 41 719, the servo hydraulic cylinders are mounted laterally on the support frame. The piston rods connected to the sides of the mold are constructed in the end portions thereof as spring elements in order to absorb tangential movements of the piston rods. The spring element whose cross section is reduced is subjected to significant tensile stresses, compressive stresses and collapsing stresses, which can lead to fatigue fractures.

SUMMARY OF THE INVENTION

Therefore, it is the primary object of the present invention to provide an oscillating device of the above-described type which is constructed so as to operate without play and permits the compensation of inaccuracies in mounting, thermal expansions and tangential movements and which simultaneously withstands the tensile stresses, compressive stresses and collapsing stresses with the required operational safety.

In accordance with the present invention, the object is met by fastening each servo hydraulic cylinder at the bottom thereof through an elastic fastening element on the support frame and by connecting the piston rods of the servo hydraulic cylinders with the mold.

As a result of the configuration according to the present invention, a lateral relative movement is not compensated by a bending of a reduced thickness portion of the piston rod, but by pivoting of the oscillation cylinder on the lower elastic fastening element. This construction provides the advantage that, by increasing the distance, bending and, thus, collapsing stresses are reduced, so that the likelihood of fatigue stresses is reduced.

In accordance with an advantageous feature of the invention, the fastening element is composed of an elastic bending web which on both sides thereof is provided with fastening flanges.

The piston rods of the servo hydraulic cylinders can be connected through joints to a mold table.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

BRIEF DESCRIPTION OF THE DRAWING

In the drawing:

The single FIGURE of the drawing is a schematic side view of a continuous casting plant with an oscillating device for the mold in accordance with the invention.

DESCRIPTION OF THE PREFERRED EMBODIMENTS

The drawing shows a preferred embodiment of the present invention.

A support frame 2 is arranged on a foundation 1. Bearing posts 3 are anchored on the support frame 2. Parallel guide members 4 are pivotally guided on the bearing posts 3. The parallel guide members 4 support a mold table 5.

A continuous casting mold 6 for slabs 7 is mounted on the mold table 5. Servo hydraulic cylinders 8 are provided for moving the continuous casting mold 6 in an oscillating manner.

The servo hydraulic cylinders 8 are mounted rigidly with the base plates 9 thereof on a fastening element 10 anchored on the support frame 2. The fastening element 10 includes a bendable web-shaped member 11 having a reduced cross section and fastening flanges 12, 13 at the upper and lower ends of the web-shaped member 11.

Piston rods 14 of the servo hydraulic cylinders 8 are connected through a joint 15 to the mold table 5.

A lateral displacement of the mold table 5 is compensated by pivoting the servo hydraulic cylinders 8 on the elastic connecting element 10, so that collapsing stresses and fatigue fractures are avoided.

While specific embodiments of the invention have been shown and described in detail to illustrate the inventive principles, it will be understood that the invention may be embodied otherwise without departing from such principles.

We claim:

1. A continuous casting mold guided in a casting direction on a support frame, the continuous casting mold comprising an oscillating device comprising servo hydraulic cylinders mounted on the support frame, the servo hydraulic cylinders comprising piston rods connected to the continuous casting mold for moving the continuous casting mold in an oscillating manner, each servo hydraulic cylinder having a bottom, further comprising an elastic fastening element connected to the bottom of each servo hydraulic cylinder, the elastic fastening element being fastened on the support frame, wherein the elastic fastening element is configured such that bending of the elastic fastening element occurs without bending of the piston rods to permit pivoting of the hydraulic cylinders.

2. The continuous casting mold according to claim 1, wherein the elastic fastening element comprises an elastic web-shaped member having two ends, the elastic fastening element further comprising fastening flanges connected to both ends of the web-shaped member.

3. The continuous casting mold according to claim 1, further comprising a mold table, the piston rods of the servo hydraulic cylinders being connected to the mold table through a joint.

* * * * *